United States Patent [19]

Bianchi et al.

[11] 4,256,243

[45] Mar. 17, 1981

[54] HOLSTER WITH HESITATION LOCK

[75] Inventors: John E. Bianchi; Richard D. E. Nichols, both of Fallbrook, Calif.

[73] Assignee: Bianchi Leather Products, Inc., Temecula, Calif.

[21] Appl. No.: 11,420

[22] Filed: Feb. 12, 1979

[51] Int. Cl.[3] ..... F41C 33/02

[52] U.S. Cl. ..... 224/244; 224/911

[58] Field of Search ..... 224/244, 243, 245, 242, 224/911, 912, 250, 913, 191, 166, 169

[56] References Cited

U.S. PATENT DOCUMENTS

| | | | |
|---|---|---|---|
| 2,349,376 | 5/1944 | Ray | 224/244 |
| 2,650,008 | 8/1953 | Morseth | 224/242 X |
| 2,783,536 | 3/1957 | McQueary | 224/245 X |
| 3,645,428 | 2/1972 | Angell | 224/244 |

FOREIGN PATENT DOCUMENTS

| | | | |
|---|---|---|---|
| 19724 | of 1912 | United Kingdom | 224/245 |

*Primary Examiner*—David A. Scherbel
*Assistant Examiner*—Jerold M. Forsberg
*Attorney, Agent, or Firm*—Wagner & Bachand

[57] ABSTRACT

A holster incorporating a spring locking member which engages a portion of a handgun to provide a physical restraint upon the holstering or drawing of the handgun to prevent inadvertent removal of the weapon or accidental loss of the handgun when the user is in strenuous movement. The spring locking member includes a leaf spring secured to the body of the holster at one end carrying at its other end a protruding head having tapered surfaces which will enter and obstruct a portion of the trigger guard region. The protruding head is not of sufficient size to contact the trigger when the handgun is fully home e.g. bottomed out in the holster. The spring member has sufficient resistance to deflection such that the weight of the handgun plus any acceleration due to strenuous activity of the user is insufficient to cause the weapon to be dislodged. The resistance to bending of the spring member however is selectd so that the normal or slightly increased withdrawal pressure by the user's hand on the gun butt is sufficient to deflect the spring and protuding head and to allow the hand gun to be removed without the use of the trigger finger.

12 Claims, 6 Drawing Figures

FIG. 1
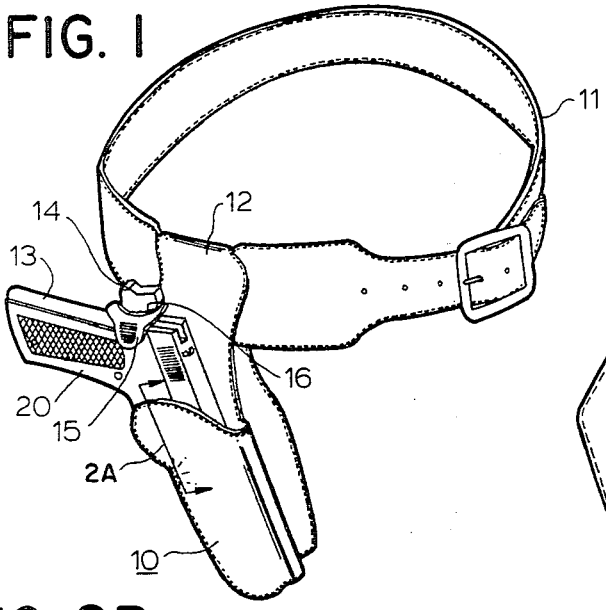
FIG. 2B
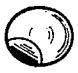
FIG. 2C
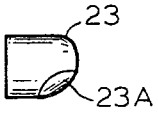
FIG. 2A
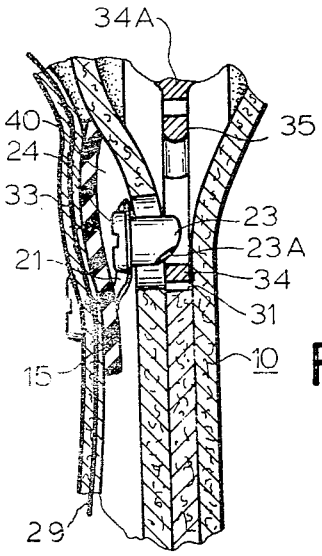
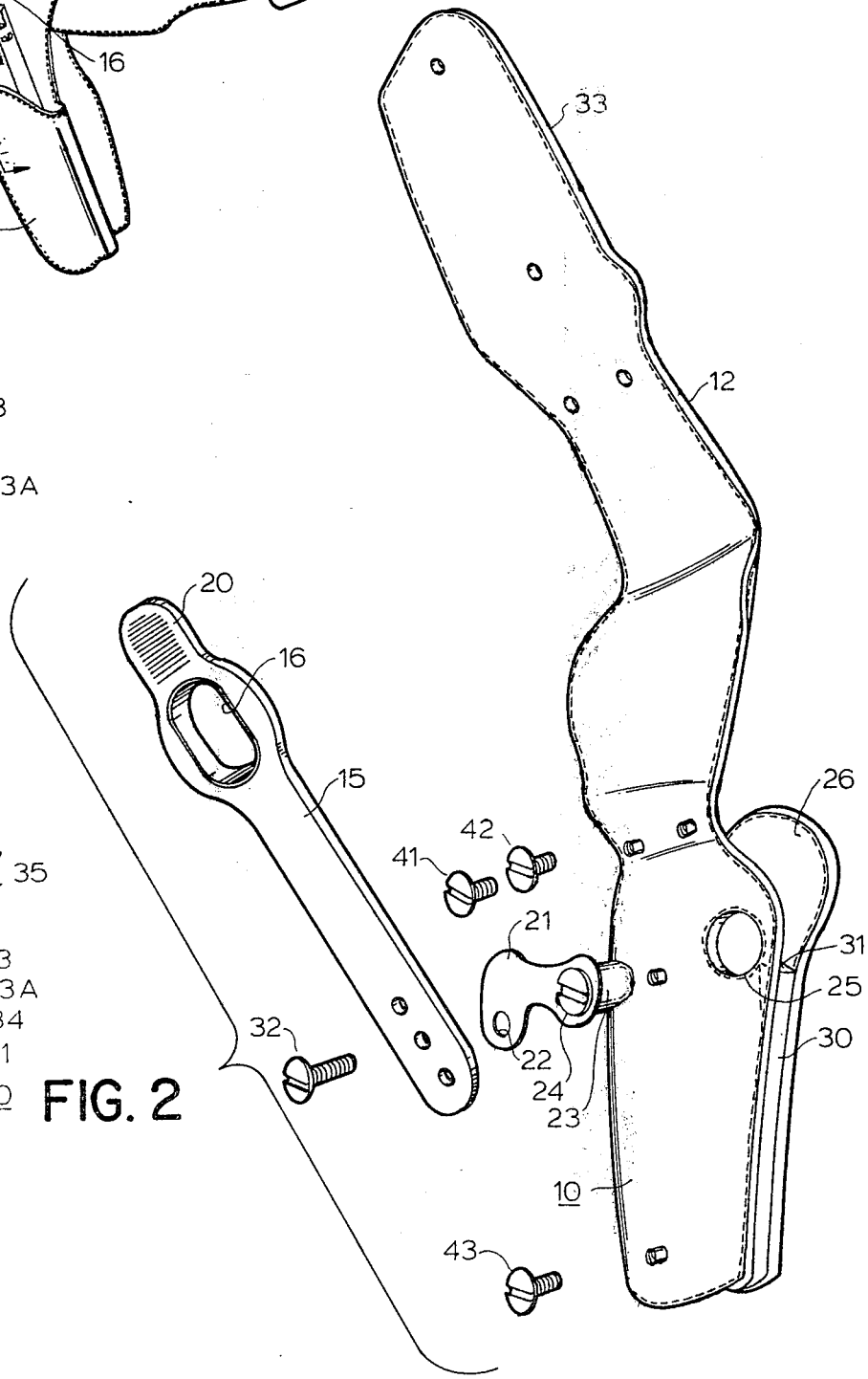
FIG. 2

HOLSTER WITH HESITATION LOCK

BACKGROUND OF THE DISCLOSURE

There has for a number of years been a recognized need for a holster which includes a locking member to prevent unauthorized removal of the hand gun by a suspect or other person when the holster is being worn by a law enforcement officer. The need for such holsters has been met by a front opening holster with a locking mechanism disclosed in the U.S. Pat. Nos. 3,749,293, 3,960,460, 3,997,583, and 4,035,902 of these inventors. Such locking mechanisms cooperate with a front opening design so that the handgun is blocked from removal upwards and is removed in a forward direction.

We have discovered however that there is a need for a lock or latch mechanism for a top opening and top removal holster designed not to prevent removal from the top of the weapon but to prevent the weapon from falling out in strenuous activities. This need has become more noticeable with the present trend towards open top or non-flap holsters for use by law enforcement officers. There has been at least one attempt in the past to place a trigger locking device within the trigger guard and that is found in a U.S. patent of approximately 50 years ago. It has been found however that devices of that type which require the user to insert his finger into the trigger guard adjacent to the trigger prior to drawing are dangerous. Inherent in the design is the situation that upward movement of the officer's hand causes his trigger finger to engage the trigger. If the weapon is cocked in a non-safety condition there is a serious danger of discharging in the holster. For this reason the prior devices of the type just described have not met with acceptance or success.

BRIEF DESCRIPTION OF THE INVENTION

Given the foregoing state of the art we have developed and invented a holster providing a hesitation lock for use in top opening and top removal holsters. The invention employs a relatively conventional holster body of whatever design the user desires with a relatively thin spring secured between the body and liner of the holster at a point spaced from the trigger of the weapon. The spring may be on the inner or outer face of the holster. The upper end of the relatively thin spring member is positioned in the general region of the trigger guard. The liner of the holster includes an opening through which a protuberance in the form of a low friction material dome shaped member extends while secured at its rear face to the spring. The protuberance member is dimensioned to fill approximately the front half of the trigger guard of the particular handgun for which the holster is designed. The spring member is of insufficient length to allow the protuberance member to engage the trigger when the handgun is fully seated and the muzzle bottomed out in the holster. The spring member may be either a flat metal stamping or a wire form.

A resilient elastomeric strap is secured to the holster body and includes an opening which fits over the hammer of the weapon and applies a continuous downward retaining force on the weapon until released by upward pressure applied by the shooter's thumb to the underside of the strap. The trigger guard locking member and resilient strap cooperate to secure the weapon of both the trigger and hammer regions.

BRIEF DESCRIPTION OF THE DRAWING

FIG. 1 is a perspective view of this invention on a belt and with an automatic weapon secured within the holster.

FIG. 2 is an exploded rear perspective view of the holster of FIG. 1.

FIG. 2A is a fragmentary vertical sectional view taken along line 2A of FIG. 1.

FIG. 2B is a front elevational view of the restraining finger of this invention.

FIG. 2C is a side elevational view of the restraining finger of this invention.

DETAILED DESCRIPTION OF THE INVENTION

Figure 3:
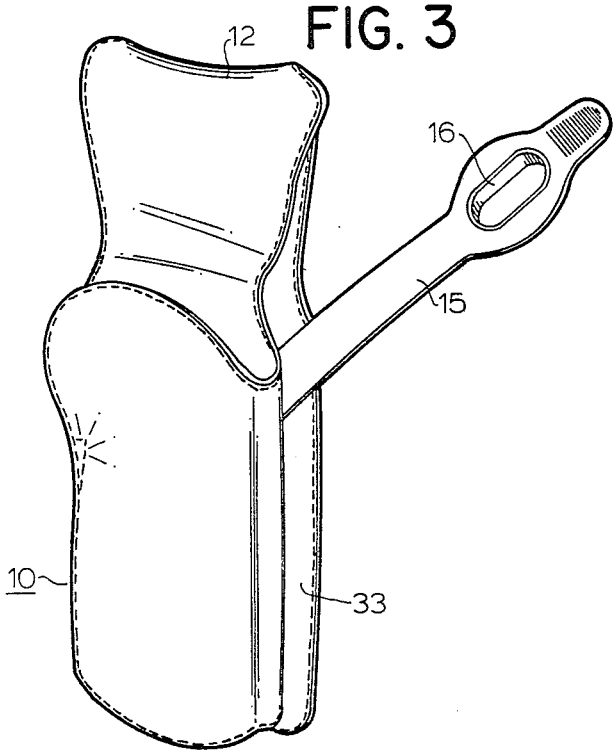
FIG. 3 is a perspective front outer quarter view of this invention empty and detached from a belt.

Now referring to FIG. 1 this invention may be seen as comprising a holster 10 secured to a belt 11 by a broad contoured belt loop portion which is formed integral with the holster body as may be seen in FIG. 2. Holstered is a weapon 13 for example an automatic pistol. As shown in FIG. 1 the automatic weapon is holstered with its hammer 14 cocked and retained in the cocked position by a resilient retainer 15 having an elongated opening 16 which encircles the hammer 14.

The retainer 15 includes an outward extending thumb tab 20 which may automatically be lifted to release the retainer 15 and allow the weapon to be drawn merely by upward movement of the thumb of the wearer. The thumb tab 20 includes serrations on both the upper and lower surface thereof to aid in the frictional engagement of the thumb tab with the upper surface of the thumb on drawing and in the subsequent placement or replacement of the cocked weapon in the holster.

The retainer 15 serves multiple functions one of which is to retain not only the hammer from the moving forward but also the weapon from being removed from the holster. Retainer 15 typically is a soft rubber and thus is easily slipped on and off of the hammer and is not the sole device protecting the weapon from unintended withdrawal. The second and principal retainer for the weapon is shown in FIG. 2. It comprises an angular arm member 21 having a mounting hole 22 at one end, and a shaped finger 23 secured to the opposite ends by a screw 24. The finger 23 extends through an opening 25 in the body of the holster 10 and lining. The finger 23 extends into the cavity 26 of the holster in the region occupied by the weapon. It is adjacent to a welt 30 which is stitched to the two sides of holster body 10 having an upper surface 31 which acts as a trigger guard stop for the weapon when in place. Thus, the finger 23 position extend through opening 25 is located immediately above the stop 31, spaced thereabove by the thickness of the trigger guard at the forward edge plus suitable clearance. This relationship may best be seen in FIG. 2A which is an enlarged fragmentary sectional view of the trigger region of the holster of FIGS. 1 and 2. It may be seen in FIG. 2A that the spring 21 carrying the finger 23 is secured to the body of the holster by a machine screw 32 which passes through the inner flap 33 used to define the belt loop portion 12 of FIGS. 1 and 2 and through an opening in the retainer 15 thereby providing three functions with a single part, namely screw 32.

Referring specifically to FIGS. 2A and 2B it may be seen that in the preferred embodiment the finger 23 has a flattened lower surface 23A designed to rest against an inner surface of the front (or bottom of the finger guard when the weapon is holstered identified in Section in FIG. 2A only as 34. Positioned behind and in FIG. 2A above the front portion of the finger guard 34 is the trigger 35 with the rear or upper portion of the finger guard 34 appearing as Section 34A. Of most significance is the fact that there is the normal clearance between the trigger 35 and the rear of the trigger guard 34A and most significantly clearance between the finger 23 and the trigger 35.

The finger 23 is contoured round on its outer end surface and except for the flat region 23A preferably at an inclined angle whereby the finger 23 may be displaced sideways or inward by contact with the trigger guard 34 at the portion shown in FIG. 2A when the weapon is either inserted in or withdrawn from the holster.

The spring 21 is selected and preferred to be of flat spring steel of 0.020" thickness, a nominal width of one half inch and a length of $\frac{3}{4}$ to $1\frac{1}{2}$ in between the point of securement by screw 32 and the center of screw 24 thus determining the stiffness and movement arm of finger 23 which is of approximately $\frac{5}{8}$" diameter. Finger 23 is preferably of molded polyamide resin such as Nylon or similar low friction material. Employing these materials and dimensions we have found that the spring 21 has sufficient stiffness to prevent the weapon from falling out from its own weight or with acceleration due to strenuous movement such as tumbling, rolling or falling. At the same time the force required for holstering and withdrawal of the weapon in overcoming the spring 21 is acceptable to the user. Additional confidence is given to the user when holstering his weapon after by a definite snap on driving the weapon home as the spring 21 and finger 23 return to their normal locking positions. An internal stiffener member 29 in the holster in FIG. 2A of the drawing, produces the offset belt loop 12 and further insures the presence of the clearance opening 40. Thus spring 21 has an assured clearance region 40 for operation without interference by either the holster body or flap 33. Screws 41 and 42 further isolate the clearance region 40 from the belt loop portion so that any relative movement between the belt and the holster as allows in normal strenuous activity does not affect the clearance region 40.

Figure 4:
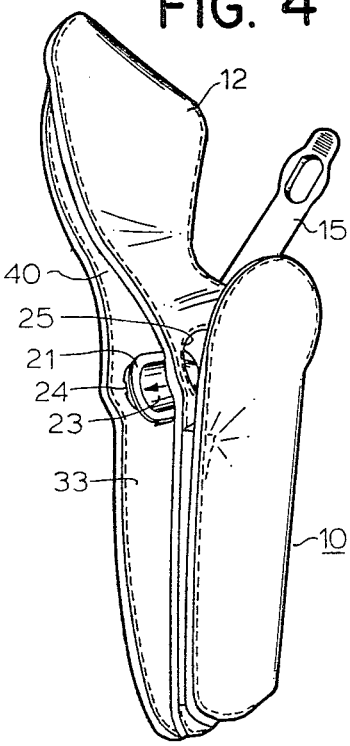
FIG. 4 is a rear outer quarter elevational view thereof.
Figure 6:
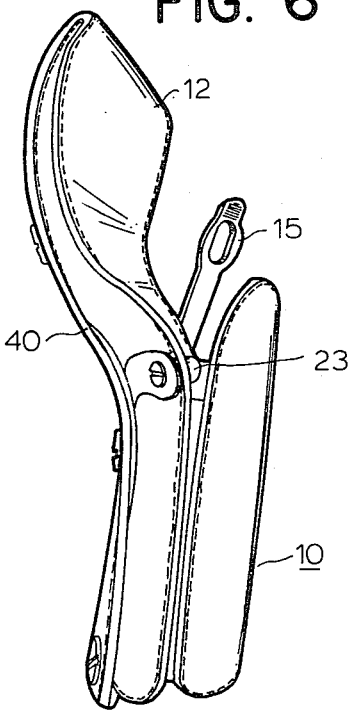
FIG. 6 is a rear elevational view of this invention.

Now referring to FIGS. 3 through 6, the holster 10 is shown from various angles. FIGS. 3 and 4 show the external appearance of the holster as seen by third parties. In FIG. 3 the resilient retainer 15 is attached to the holster 10 and in FIG. 5 the retainer is removed. It is apparent in FIGS. 3 and 5 that the holster has a relatively large rear flap 32 providing stability for the holster on the wearer's belt. Rear flap 33 as shown in FIGS. 2 through 6 is approximately as broad as the holster and is secured to the holster body by several spaced screws (see FIG. 2).

The flap 33 constituting an extension of the holster body provides a clearly defined clearance region for spring 21 and finger 23 since it is secured to the holster body both above and below the spring 21 by upper screws 41 and 42 and lower screw 43 best seen in FIG. 2. Screws 41, 42, and 43 define the length of the clearance opening 40. The width of the clearance opening is of course the width of the flap 33. The retainer 15 which is secured between the holster body and flap 33 by the screw 32 defines the minimum lateral dimension.

FIG. 4 shows the holster of this invention with the locking finger 23 and spring 21 deflected out of the holster pocket in simulation of its position during holstering or drawing of the weapon as the front of the trigger guard passes opening 25. The clearance region 40 is in use in FIG. 4.

Figure 5:
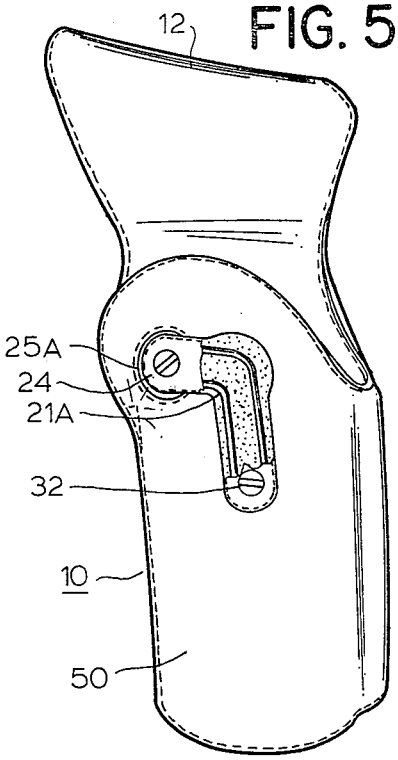
FIG. 5 is a side elevational view of an alternate embodiment of this invention with the resilient strap removed.

FIG. 5 shows an alternate embodiment of this invention, in which the hesitation lock is located on the outer face of the holster body and a formed wire 50 spring 21A is employed in place of the flat spring 21 of the remainder of the figures. The spring 21A is preferably in the form of a closed elongated loop with ends of small enough opening to allow screws 24 and 32 to pass through the ends of the loops and hold the spring securely. The opening 25A is on the outer face 50 of the holster body and the finger 23 extends through that opening 25A and unshown in FIG. 5. To improve the asthetics of this alternate embodiment spring 21A is provided with a leather cover 51 and 52 top and bottom with the outer cover 52 partially broken away to expose spring 21A. For asthetic and operational reasons the embodiment of FIGS. 1–4 and 6 is preferred since the hesitation lock is there concealed and protected.

The above described embodiments of this invention are merely descriptive of its principles and are not to be considered limiting. The scope of this invention instead shall be determined from the scope of the following claims, including their equivalents.

We claim:

1. A holster with a hesitation lock comprising a holster body and means for securing the holster to a user's belt;

said holster body defining a pocket for holding a handgun and including a region of the body thereof which encloses the trigger guard of a handgun when positioned in the holster;

said holster body further including a stop for engaging and limiting the extent of inward movement of the trigger guard within said pocket;

elongated spring means secured to said holster body at one end in the general region of the muzzle of the weapon and having the opposite end unrestrained;

means engaging the unrestrained end of said spring means protruding into the trigger guard of a hand gun when positioned in the holster against said stop;

said stop is so positioned in said holster and cooperating with said spring means having insufficient length to allow said protuberance means to engage a trigger when the hand gun is fully bottomed out within the holster against said stop;

said spring means having sufficient resistance to bending to prevent the weight of the weapon when the holster is inverted from deflecting the spring and allowing the weapon to fall;

said spring having a resistance to deflection insufficient to prevent the withdrawal of the hand gun by drawing pressure applied to the grip of the handgun.

2. The combination in accordance with claim 1 wherein said holster body covers the trigger guard region of the handgun when placed in the holster and said protuberance member extends through an opening in said holster body in the region of the trigger guard.

3. The combination in accordance with claim 1 wherein said protuberance constitutes a generally rounded member positioned to be deflected upon engagement of said rounded end with the trigger guard of a handgun upon the insertion thereof into the holster.

4. The combination in accordance with claim 3 wherein said protuberance member is of molded plastic material and includes an inclined surface engageable with the trigger guard upon the withdrawal of the handgun in order to facilitate sideways displacement of the protuberance by the trigger guard.

5. The combination in accordance with claim 1 wherein said spring member is secured to the face of the holster body adjacent to the wearer's body.

6. The combination in accordance with claim 5 wherein said spring member is secured to the outer surface of the holster body.

7. The combination in accordance with claim 5 wherein said holster includes an internal liner in said handgun holding pocket and said spring member is secured between the holster body and said internal liner.

8. The combination in accordance with claim 1 wherein said spring member is a flat spring.

9. The combination in accordance with claim 1 wherein said spring member is a formed wire part.

10. The combination in accordance with claim 1 wherein said means for securing said holster to a user's belt comprises an extension of said holster body folded at the top to define a belt loop and extending downward and secured to the inner face of said holster body at a position below said spring means.

11. The combination in accordance with claim 10 wherein said extension is spaced from the inner face of said holster body defining a clearance space for deflection of said spring means.

12. The combination in accordance with claim 11 including means securing said extension to said holster body both above and below said spring means thereby defining a clearly defined clearance region for said spring means independent of said belt loop.

* * * * *